United States Patent [19]

Poirier d'Ange d'Orsay

[11] 4,211,196

[45] Jul. 8, 1980

[54] CARBURETOR

[75] Inventor: Emmanuel J. H. Poirier d'Ange d'Orsay, Toulouse, France

[73] Assignee: Societe pour l'Equipement de Vehicules, Issy-les-Moulineaux, France

[21] Appl. No.: 902,915

[22] Filed: May 5, 1978

[30] Foreign Application Priority Data

May 12, 1977 [FR] France ..... 77 14558

[51] Int. Cl.[2] ..... F02M 7/12

[52] U.S. Cl. ..... 123/439; 261/36 A; 261/44 E; 261/64 C; 261/DIG. 56; 261/DIG. 74

[58] Field of Search ..... 261/36 A, DIG. 56, 50 A, 261/44 H, 44 E, DIG. 74, 64 C; 123/119 EC

[56] References Cited

U.S. PATENT DOCUMENTS

| | | | |
|---|---|---|---|
| 3,342,464 | 9/1967 | Mick | 261/50 A |
| 3,570,824 | 3/1971 | Strohm et al. | 261/DIG. 56 |
| 3,704,867 | 12/1972 | Diehl | 261/DIG. 56 |
| 3,752,451 | 8/1973 | Kendig | 261/50 A |
| 3,785,627 | 1/1974 | Tuzson et al. | 261/36 A |
| 3,939,230 | 2/1976 | Simon | 261/50 A |
| 3,978,175 | 8/1976 | Stoltman | 261/50 A |
| 4,021,513 | 5/1977 | Ullman | 261/DIG. 56 |
| 4,089,311 | 5/1978 | Brettschneider et al. | 261/50 A |
| 4,096,211 | 6/1978 | Rameau | 261/DIG. 56 |
| 4,130,610 | 12/1978 | Paul | 261/36 A |
| 4,152,376 | 5/1979 | Tuzson | 261/36 A |

FOREIGN PATENT DOCUMENTS

| | | | |
|---|---|---|---|
| 2006739 | 8/1971 | Fed. Rep. of Germany | 261/DIG. 56 |
| 2219880 | 10/1973 | Fed. Rep. of Germany | 261/DIG. 56 |
| 210521 | 2/1924 | United Kingdom | 261/DIG. 56 |

*Primary Examiner*—Tim R. Miles
*Attorney, Agent, or Firm*—Brisebois & Kruger

[57] ABSTRACT

A fluid jet type of carburetor, namely one in which a jet of fuel passes across the combustion air path and has some of the fuel entrained by the passing combustion air and the rest of the fuel recycled, includes means for concentrating the flow of combustion air at the zone of fuel/air mixing where the jet of fuel is exposed to the combustion air. Increasing the degree of concentration of the combustion air at the mixing zone enriches the mixture, and vice versa.

11 Claims, 1 Drawing Figure

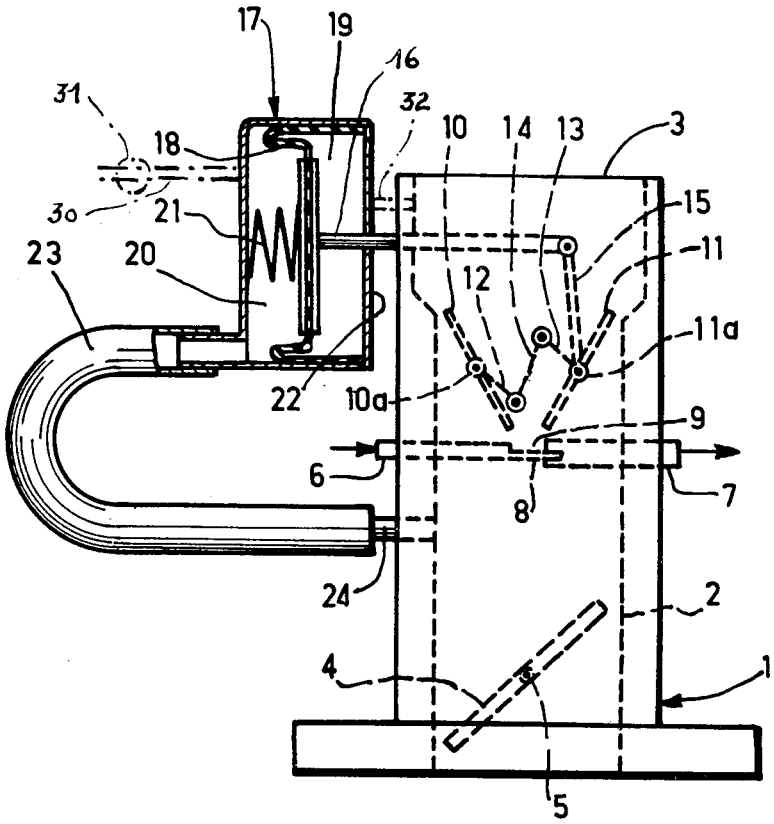
17
19
16
31
32
18
10
14
13
3
30
21
15
23
20
11
12
11a
22
10a
9
6
8
7
24
2
4
1
5

CARBURETOR

It is known that the fuel supply and carburation of an internal combustion engine can generally be effected either by means of a fuel injector pump, or by means of a carburettor in which a mixture of air and finely divided fuel is formed, said mixture being then supplied to the combustion chambers of the motor. The present invention relates to a fuel supply device of the second type mentioned above, that is to say a device which comprises at least one carburettor.

In French Patent No. 2,196,436 a new type of carburettor has been proposed in which the quantity of the liquid fuel passing along the fuel pipe is much greater than the quantity of fuel required for fuelling the motor, the flow difference beng recycled to the fuel reservoir chamber, the so-called float chamber.

The present invention more specifically relates to a fuelling device which comprises at least one carburettor of the type described in the said French Patent No. 2,196,436, which corresponds to U.S. Pat. No. 3,785,627.

Carburettors of this known type comprise (a) an inlet duct which opens into the combustion air flow path and (b) an outlet duct which receives and recycles part of the fuel flow from the inlet duct, the difference between the inlet and outlet duct flows being entrained by the combustion air to form the fuel/air mixture which is to be introduced into the combustion chambers or cylinders. In a particular arrangement described in the said French Patent, the end of the duct is opposite the end of the outlet duct so as to form therebetween a zone in which the jet of fuel is directly in contact with the combustion air and may thus be partially entrained by said air. It has been noted that the functioning of such a carburettor may not be satisfactory when the volume flow rate of combustion air through the carburettor is low, for example when the throttle butterfly is almost closed and only allows a small opening for the combustion air flow and/or when the engine speed is sufficiently low for the air induction to be very weak. In these particular conditions of operation, the fuel/air mixture is too weak leading to poor operation of the engine.

The present invention has as its object the overcoming of the above-mentioned disadvantage by providing means for ensuring a fuel/air mixture having a richness which corresponds to optimum operation of the engine for all operating conditions.

During the remainder of the specification and claims, the type of carburettor described in French Patent No. 2,196,436 and improved on by the present invention will be designated by the general term "fluid jet carburettor".

According to the present invention there is provided a device for feeding a fuel/air mixture, for fuelling an internal combustion engine, comprising: at least one fluid jet carburettor in which, in use, a flow of fuel passes from an inlet duct to an exhaust duct across the flow of combustion air at a zone of direct contact between the fuel and the combustion air, a control vane interposed between the said zone of direct contact and the outlet end of the device; means in the path of the combustion air, upstream of the zone of direct contact between the fuel and the combustion air, for concentrating the flow of combustion air to a greater or lesser extent at said zone of direct contact for maintaining the richness of the mixture leaving the fluid jet carburettor at a desired value in response to signals from at least one sensor.

In a preferred embodiment, the richness of the fuel/air mixture is maintained, whatever the operating conditions and the engine load, at a value permitting satisfactory operation of the motor. The path of the fuel through the contact zone is substantially perpendicular to the axis of the combustion air flow through said zone. At least a part of the boundary surface of the contact zone may be adjustable in response to signals from at least one sensor, and this control may or may not be connected to that of the means for concentration of the combustion air at the contact zone.

In a first variant of this embodiment, the means for concentrating the combustion air at the contact zone comprises at least one movable and/or deformable concentrating vane. In another varient, the means for concentrating the combustion air is a diaphragm which may be flat, cylindrical or conical, the axis of the diaphragm being adjacent or coincident with the axis of the combustion air flow in the vicinity of the contact zone.

Where the means for concentrating the combustion air comprises at least one vane, said vane may be flat or curved and may have several possible positions, in one of which it effects substantially nil concentration of the combustion air at the contact zone, whereby in said one position the vane only presents a minimum disturbance to the combustion air flow. The means for concentrating the combustion air at the contact zone may advantageously be constituted by several movable vanes which may be pivotable or translatable. The means for concentrating the combustion air at the contact zone is preferably constituted by two pivotable vanes which are symmetric with respect to the axis of the combustion air flow, these two vanes being linked for movement simultaneously. The notional intersection edge of the dihedron formed by the two concentration vanes may be substantially parallel or perpendicular to the path of the fuel at the contact zone.

The sensor controlling the means for concentrating the combustion air at the contact zone may be an aneroid capsule comprising a flexible diaphragm which separates two chambers one of which is connected to a suction tapping in the combustion air flow path between the contact zone and the control vane. That chamber of the aneroid capsule which is not connected to the suction tapping may be communicated with the atmosphere or be isolated from ambient air and maintained at a fixed pressure. The diaphragm of the aneroid capsule controls, by a translatable piston rod, the simultaneous pivoting of two concentration flaps.

Advantageously the chamber which is connected to the suction tapping may also be connected to atmosphere, this communication with atmosphere being controlled by an electromagnetic valve controlled in response to certain operating parameters of the engine. Further, that chamber of the aneroid capsule which is not connected to the suction tapping may communicate with the flow path of combustion air at a location upstream of the means for concentrating the combustion air flow.

In a second embodiment, the means for concentrating the combustion air at the contact zone is controlled by signals from at least one sensor measuring the speed of rotation of the engine and/or the degree of opening of the control vane.

In a third embodiment, the means for concentrating the combustion air at the contact zone is controlled by a sensor measuring the quantity of oxygen present in the exhaust gases.

It is clear that the device according to the invention permits the quantity of fuel entrained by the combustion air flow to be increased in operating conditions where, in the absence of the air flow concentrating means, the fuel/air mixture would be too weak. In fact, if the controlling sensor indicates operating conditions where the fluid jet carburettor of known type does not give a satisfactory mixture richness, the combustion air can be concentrated or concentrated to a greater extent at the contact zone, for example by pivoting the two concentration vanes, to increase the degree of entrainment of fuel by the combustion air at said contact zone. Although this explanation is not to be considered in any way limiting of the scope of the invention, it is thought that the variation of the degree of entrainment of the fuel is very largely a function of the variation of the relative speed of the combustion air with respect to the fuel in the contact zone.

In order that the present invention may better be understood, there will now be described by way of purely illustrative and non-limiting example, one embodiment shown on the accompanying drawing in which the single FIGURE represents in schematic elevation a fluid jet carburettor according to the invention, the means for concentrating the combustion air comprising two pivoting vanes and the control sensor being an aneroid capsule shown in section.

Referring now to the drawing, there can be seen the body 1 of a fluid jet carburettor of the type described in French Pat. No. 2,196,436. The body 1 defines internally a substantially cylindrical channel 2 along which the combustion air flow moves. The channel 2 has an entrance 3 and an exit which is equipped with a control vane 4 commonly known as a throttle "butterfly". The butterfly vane 4 may be pivoted about the spindle 5 for controlling the quantity of fuel/air mixture which it is desired to supply to the engine inlet. In the central zone of the channel 2, along a direction perpendicular to the axis of said channel, and intersecting said axis are an inlet duct 6 and an outlet duct 7 for fuel. The duct 6 is extended along the interior of the channel 2 and terminates at a zone 8 open at its upper half; the zone 8 is thus constituted by a tube cut in two along a diametral plane, this tube forming a trough in which the outlet duct 7 lies. The fuel jet supported in the trough 8 passes into the outlet duct 7, but along the trough 8 the fuel is in direct contact with the flow of combustion air along the channel 2. The zone of direct contact of this carburettor is thus above the trough 8 and is designated 9 on the drawing.

The means for concentrating the combustion air is constituted by two concentration vanes 10 and 11. The vanes 10 and 11 are planar and symmetrical with respect to the axis of the channel 2 and they define a dihedron whose notional intersection edge is perpendicular to the axis common to the ducts 6 and 7. The vanes 10 and 11, which pivot around fixed respective spindles **10*a* and 11*a*, are fixed with respect to two arms 12 and 13 which are connected together by means of a link 14 articulated at its two ends to the two arms 12 and 13**. In this way, all pivotal movement of one concentration vane is manifested as a pivotal movement to the other concentration vane of equal angle and in the opposite direction.

The vane 11 is, further, fixed to an arm 15 whose end is articulated in the appropriate manner to a control rod 16 of an aneroid capsule designated in its entirety as 17. A translation movement of the rod 16 results in rotation of the vane 11, and consequently, a change in the dihedral angle defined by the two concentration vanes 10 and 11. For one position of the rod 16, the two vanes 10 and 11 may be parallel and, in this case, they will not carry out any concentrating action and will only constitute a minimum disturbance to the combustion air flow in the channel 2. When the dihedral angle formed by the concentration vanes 10 and 11 increases, the flow of combustion air along the channel 2 becomes more concentrated towards the zone occupied by the notional apex of the dihedron. When the air concentrating vanes 10 and 11 form their maximum angle, which is the case represented on the drawing, the notional intersection edge of the dihedron passes substantially through the contact zone 9 and the vanes 10 and 11 constrict the channel 2 in such a way that all the combustion air flow is directed across the contact zone 9. It can be seen therefore that, depending on the position of the rod 16, it is possible to concentrate the flow of combustion air passing along the channel 2, to a greater or lesser extent, at the contact zone 9.

The aneroid capsule 17 comprises a flexible diaphragm 18 which separates two chambers 19 and 20. A spring 21 is interposed between the rear of the chamber and the central zone of the diaphragm 18, said diaphragm central zone being connected mechanically to the end of the rod 16. The chamber 19 is in communication with ambient atmosphere by means of orifices 22. The chamber 20 is in communication, by a flexible tube 23, with a suction tapping 24 which opens into the combustion air channel 2 between the butterfly vane 4 and the plane where the ducts 6 and 7 are.

When the suction at the level of the tapping 24 is considerable, for example when the butterfly vane 4 is wide open and the speed of rotation of the engine is high, the spring 21 will be compressed and the rod 16 displaced towards the left as viewed on the drawing, this corresponding to a rotation of the concentration vanes 10 and 11 to bring those vanes to a position where they enclose a shallow or even a null angle. It can be seen thus that there is no concentrating action of the vanes 10 and 11 in the operating case where the fluid jet carburettor would in any case give a mixture having a satisfactory strength.

If, on the contrary, the suction at the level of the tapping 24 is low, the vanes 10 and 11 pivot to form a dihedron of greater included angle, as shown on the drawing. The flow of combustion air is thus concentrated at the contact zone 9. It is known that in these operating conditions conventional fluid jet carburettors give mixtures which are too weak. By concentrating the flow of combustion air at the zone 9 it can be seen that the mixture is enriched and that the strength can be brought to the optimum value for efficient operation of the engine.

In a variant embodiment, whose specific elements are shown in dot-dash lines on the drawing, the chamber 20 may be communicated with the atmosphere by virtue of a tube 30 which includes a solenoid control valve 31 to enable the inlet of air into the chamber 20 to be controlled to modulate the suction which prevails there. This modulation is effected in response to the value of certain operating parameters of the engine such as: the composition of the exhaust gas, the engine speed, certain temperatures, the position of the gas butterfly, and the inlet manifold depression. These parameters are translated into electric signals for controlling the solenoid valve 31. Further, in this variant, the chamber 19 may be connected by a pipe 32 to the inlet 3 of the combustion air channel 2. This variant makes it possible to introduce into the operation of the carburettor several parameters which have not been taken into account in the embodiment described above.

It should be understood that the embodiments described above are not in any way limiting and are capable of any desirable modification, without thereby departing from the scope of the invention as defined in the claims. In particular the air concentrating vanes 10 and 11 may not be planar but may instead have a form curved in accordance with the form of the channel 2. The vanes 10 and 11 may be replaced by translatable plates which penetrate into the interior of the channel 2, or by a diaphragm which may be planar extending across the air channel cross-section over the outer region, or of cylindrical or conical form and coaxial with the channel 2. Control of the rod 16 may be effected by a type of sensor other than the aneroid capsule 17, for example by a sensor measuring the oxygen content of the engine exhaust gases.

I claim:

1. A device for feeding a fuel/air mixture for fuelling an internal combustion engine, comprising:

(a) fluid jet carburettor means having a combustion air path, a mixing zone in said combustion air path for fuel/air contact, a fuel inlet to said mixing zone and a fuel outlet for recycled fuel from said mixing zone whereby, in use, a flow of fuel passes from said fuel inlet to said fuel outlet across the flow of combustion air at said mixing zone in direct contact with the combustion air;

(b) fuel/air mixture flow rate control means interposed between the said mixing zone and the outlet end of the device;

(c) sensor means responsive to at least one parameter of at least one of said device and said internal combustion engine;

(d) means in said combustion air path, upstream of said mixing zone, for concentrating the flow of combustion air to a greater or lesser extent onto said mixing zone for maintaining the richness of the fuel/air mixture leaving said fluid jet carburettor means at a desired value in response to signals from said sensor, the means for concentrating the combustion air at the zone of direct contact being a movable concentrating vane means, a suction tapping in the combustion air path between said zone of direct contact and the control vane means, and said sensor means comprising an aneroid capsule comprising first and second chambers and a flexible diaphragm which separates said first and second chambers, said first chamber being connected to said suction tapping, said first chamber of the aneroid capsule being also connected to atmosphere, and wherein a solenoid valve operated in response to engine operating parameters is included between said first chamber and the atmosphere.

2. A device according to claim 1, wherein said sensor means comprises control means operating said concentrating means to optimise the richness of the fuel/air mixture, for all operating conditions and load values of said internal combustion engine, to permit efficient operation of said engine.

3. A device according to claim 1, wherein, the said flow of fuel from said fuel inlet to said fuel outlet is substantially perpendicular to the combustion air flow path in said mixing zone.

4. A device according to claim 1, wherein said concentrating vane means comprise at least one vane having a form which is one of planar and curved, and having one of a plurality of possible positions in which in one position it effects both substantially no concentration of the combustion air at said mixing zone and also the minimum of disturbance to the combustion air flow.

5. A device according to claim 1, wherein said means for concentrating the combustion air at the mixing zone comprises plural concentration vanes each having a pivoting motion.

6. A device according to claim 5, wherein there are two said concentration vanes having pivoting motion, said vanes being symmetrical with respect to the axis of the combustion air flow at said mixing zone, and linkage means for linking these two vanes for simultaneous movement.

7. A device according to claim 6, wherein said two concentration vanes define a dihedron having a notional intersection edge which is substantially perpendicular to the path of fuel in the mixing zone.

8. A device according to claim 6, wherein said linkage means includes a translatable rod which controls the simultaneous pivoting of two concentration vanes and is connected to said diaphragm of the aneroid capsule.

9. A device according to claim 2, 3 or 1, wherein said second chamber of the aneroid capsule communicates with the path of the combustion air upstream of the means for concentrating said combustion air flow.

10. A device according to any one of claims 2, 3 or 1, wherein the said sensor means is responsive to at least one of the speed of rotation of the engine and the degree of opening of the said control means.

11. A device according to any one of claims 2, 3 or 1, wherein said sensor means is responsive to the oxygen content of the exhaust gases.

* * * * *